US009982328B2

(12) United States Patent
Garat

(10) Patent No.: US 9,982,328 B2
(45) Date of Patent: May 29, 2018

(54) CASTING MADE FROM ALUMINIUM ALLOY, HAVING HIGH HOT CREEP AND FATIGUE RESISTANCE

(75) Inventor: Michel Garat, Moirans (FR)

(73) Assignee: Rio Tinto Alcan International Limited, Montreal (CA)

( * ) Notice: Subject to any disclaimer, the term of this patent is extended or adjusted under 35 U.S.C. 154(b) by 713 days.

(21) Appl. No.: 13/055,394

(22) PCT Filed: Jul. 1, 2009

(86) PCT No.: PCT/FR2009/000807
§ 371 (c)(1),
(2), (4) Date: Jan. 21, 2011

(87) PCT Pub. No.: WO2010/012875
PCT Pub. Date: Feb. 4, 2010

(65) Prior Publication Data

US 2011/0126947 A1 Jun. 2, 2011

(30) Foreign Application Priority Data

Jul. 30, 2008 (FR) ..... 08 04333

(51) Int. Cl.

| | |
|---|---|
| ***C22C 21/02*** | (2006.01) |
| ***C22C 21/04*** | (2006.01) |
| ***C22F 1/043*** | (2006.01) |
| ***C22F 1/057*** | (2006.01) |
| *F02F 1/24* | (2006.01) |

(52) U.S. Cl.
CPC ..... *C22C 21/02* (2013.01); *C22C 21/04* (2013.01); *C22F 1/043* (2013.01); *C22F 1/057* (2013.01); *F02F 1/24* (2013.01); *F05C 2201/906* (2013.01)

(58) Field of Classification Search
CPC ..... C22C 21/02; C22C 21/04
USPC ..... 148/417, 418; 420/535
See application file for complete search history.

(56) References Cited

U.S. PATENT DOCUMENTS

| | | | | |
|---|---|---|---|---|
| 4,163,266 | A * | 7/1979 | Tamamura et al. | 360/84 |
| 5,415,710 | A * | 5/1995 | Shiina | C22C 21/02 148/439 |
| 2005/0224145 | A1 | 10/2005 | Laslaz | |
| 2006/0133949 | A1 | 6/2006 | Laslaz | |
| 2008/0006149 | A1 * | 1/2008 | Kato et al. | 92/261 |

FOREIGN PATENT DOCUMENTS

| | | | | |
|---|---|---|---|---|
| EP | 1651787 | A | 5/2006 | |
| EP | 1651787 | B | 9/2007 | |
| EP | 1975262 | A2 * | 10/2008 | C22C 21/02 |
| FR | 2690927 | A | 11/1993 | |
| FR | 2690927 | A1 * | 11/1993 | |
| FR | 2841164 | A1 | 12/2003 | |
| FR | 2857378 | A1 | 1/2005 | |
| JP | 58100654 | A | 6/1983 | |
| JP | 2001115226 | A * | 4/2001 | |

OTHER PUBLICATIONS

Chuimert R Et Garat: "Choix D'Alliages D'Aluminium de Moulage Pour Culasses Diesel Fortement Sollicitees Choice of Moulding Aluminium for Diesel Cylinder Head with Hard Thermal Fatigues" Ingenieurs de L'Automobile, Editions VB, Garches, FR, No. 655, Mar. 1, 1990 (Mar. 1, 1990), pp. 45-49, XP000136215 ISSN: 0020-1200 Resultats; p. 47 Conclusions; p. 49.

Garat, Michel; Laslaz, Gerard.: "Alliages d'aluminium ameliores pour culasses Diesel" Hommes et Fonderie, Feb. 1, 2008 (Feb. 1, 2008), XP008100499 cited in the application the whole document.

Javidani et al., Application of cast Al—Si alloys in internal combustion engine components, journal, 27 pp., International Materials Reviews, Institute of Materials, Minerals and Mining and ASM International, vol. 000, No. 000, 2014.

Han et al., Optimizing the tensile properties of Al—Si—Cu—Mg 319-type alloys: Role of solution heat treatment, journal, Sep. 19, 2013, 13 pp., Materials and Design, vol. 58, 2014.

Ibrahim et al., Metallurgical parameters controlling the microstructure and hardness of Al—Si—Cu—Mg base alloys, Journal, Jul. 25, 2010, 13 pp., Materials and Design, vol. 32, 2011.

* cited by examiner

*Primary Examiner* — George Wyszomierski
*Assistant Examiner* — Janelle Morillo
(74) *Attorney, Agent, or Firm* — Banner & Witcoff, Ltd.

(57) ABSTRACT

The subject of the invention is a cast part with high static mechanical strength, and for fatigue and hot creep, made of aluminum alloy of composition:

Si: 3-11%, preferably 5.0-9.0%
Fe<0.50%, preferably <0.30%, preferably still <0.19% or even 0.12%
Cu: 2.0-5.0%, preferably 2.5-4.2%, preferably still 3.0-4.0%
Mn: 0.05-0.50%, preferably 0.08-0.20%
Mg: 0.10-0.25%, preferably 0.10-0.20%
Zn: <0.30%, preferably <0.10%
Ni: <0.30%, preferably <0.10%
V: 0.05-0.19%, preferably 0.08-0.19%, preferably still 0.10-0.19%
Zr: 0.05-0.25%, preferably 0.08-0.20%
Ti: 0.01-0.25%, preferably 0.05-0.20%
other elements <0.05% each and 0.15% in total, the rest aluminum.

It more particularly relates to cylinder heads for supercharged diesel or petrol internal combustion engines.

27 Claims, 6 Drawing Sheets

CASTING MADE FROM ALUMINIUM ALLOY, HAVING HIGH HOT CREEP AND FATIGUE RESISTANCE

CROSS-REFERENCE TO RELATED APPLICATIONS/PRIORITY CLAIM

The present application is a U.S. National Phase filing of International Application No. PCT/FR2009/000807 filed on Jul. 1, 2009, designating the United States of America and claiming priority to France Patent Application No. 08/04333, filed on Jul. 30, 2008, both of which applications the present application claims priority to and the benefit of, and both of which applications are incorporated by reference herein in their entireties.

FIELD OF THE INVENTION

The invention relates to parts cast in aluminum alloy subject to high mechanical stresses and working, at least in some of their zones, at high temperatures, in particular cylinder heads of supercharged diesel or petrol engines.

BACKGROUND OF RELATED ART

Unless otherwise stated, all the values relating to the chemical composition of the alloys are expressed as a percentage by weight.

The alloys usually used for the cylinder heads of mass-produced motor vehicles are on the one hand alloys of the type AlSi7Mg and AlSi10Mg, possibly "doped" by the addition of 0.50% to 1%, of copper, and on the other hand alloys of the family AlSi5 to AlSi5-9Cu3Mg.

The alloys of the first type, AlSi7(Cu)Mg and AlSi10(Cu)Mg with T5 treatment (simple stabilization) and T7 treatment (complete solution heat-treatment, quenching and over-ageing) have sufficient mechanical characteristics when hot up to approximately 250° C., but not at 300° C., a temperature which will nevertheless be reached by the valve bridges of the new generations of supercharged diesel engines with a common rail, and even the new doubly supercharged petrol engines.

At 300° C., their yield strength and their creep strength are particularly low. On the other hand, because of their good ductility throughout the temperature range, from ambient up to 250° C., they satisfactorily withstand cracking by thermal fatigue.

Alloys of the type AlSi5 to AlSi5-9Cu3Mg0.25 to 0.5, which have better elevated temperature strength, have, in contrast, rather low ductility which makes them very vulnerable to cracking by thermal fatigue.

They are subdivided into a family of alloys with low iron content, typically lower than 0.20%, known as primary alloys (obtained from a smelter), which has good hot ductility but remains fragile at ambient temperature, and a family of alloys known as secondary alloys (obtained from recycling) with a higher iron content, from 0.40% to 0.80% and sometimes 1%, which have low ductility both when hot and at ambient temperature.

These problems were described for example in the article by R. Chuimert and M. Garat "Choice of aluminum casting alloys for diesel cylinder heads subjected to strong forces" published in the SIA Review of March 1990. This article summarized the properties of the three alloys examined as follows:

AlSi5Cu3Mg with low iron content (0.15%) and in state T7: very good mechanical resistance up to 250° C., becoming average at 300° C., low ductility at ambient temperature, becoming good at 250 and 300° C.

AlSi5Cu3Mg with high iron content (0.7%) and in state F (without heat treatment): average mechanical resistance at ambient temperature, becoming relatively highest at 250 and 300° C., very low ductility throughout the field 20-300° C.

AlSi7Mg0.3 without copper and with low iron content (0.15%) and in state T7: mechanical resistance at ambient temperature good, becoming very low as of 250° C., very good ductility throughout the field 20-300° C.

The progress made since 1990 was described in the recent article by M. Garat and G. Laslaz "Improved aluminum alloys for diesel cylinder heads" published in the review "Hommes et Fonderie" of February 2008. In its introduction, this article sketches a review of the various families of alloys currently used and their relationship with forces undergone and architectures of modern cylinder heads.

It presents the recent developments in the field of alloys:

Alloy AlSi7Mg0.3, with the addition of 0.50% of copper and in state T7, a solution today used widely in industry, provides a very noticeable gain (+20%) of yield strength 250° C., without loss of elongation. But the gain provided by this small addition of copper is completely lost at 300° C.

The addition of 0.15% of zirconium in the same alloy makes it possible to slightly improve the yield strength at 300° C. (+10%) and especially to delay tertiary creep at the same temperature at a stress of 22 MPa.

A new type of AlSi7Cu3.5MnVZrTi alloy without magnesium was examined and characterized. It has excellent hot mechanical resistance properties at 300° C. and fairly good ductility throughout the field 20-300° C., but low yield strength at ambient temperature (about 190 to 235 MPa depending on its exact copper content). This alloy is in conformity with patents FR 2 857 378 and EP 1 651 787 by the applicant.

The results of these latest developments are summarized in table 1 below (tensile strength Rm in MPa, yield strength $R_{p0.2}$ in MPa and elongation at break A as a percentage, representing the stress in MPa leading to a deformation of 0.1% after being held at the same temperature for 100 h):

TABLE 1

| | | 20° C. | | | 250° C. | | | | 300° C. | | | |
|---|---|---|---|---|---|---|---|---|---|---|---|---|
| Alloy | State | Rp0.2 | Rm | A | | Rp0.2 | Rm | A | | Rp0.2 | Rm | A |
| AlSi7Mg0.3Ti (Fe 0.15, Primary) | T6 | 211 | 295 | 15.7 | 57 | 69 | 29 | 40-45 | 41 | 53 | 32 | 22 |
| AlSi7Mg0.3Ti (Fe 0.15, Primary) | T7 | 257 | 299 | 9.9 | 55 | 61 | 34.5 | 38.8 | 40 | 43 | 34.5 | 21.7 |
| AlSi7Cu0.5Mg0.3Ti (Fe 0.15, Primary) | T7 | 275 | 327 | 9.8 | 66 | 73 | 34.5 | 39.5 | 40 | 44 | 34.6 | 21.8 |
| AlSi5Cu3Mg0.3 (Fe 0.7, Secondary) | F | 172 | 237 | 2.1 | 107 | 133 | 5.8 | 53 | 60 | 86 | 12 | 26 |
| AlSi7Cu3Mg0.3 (Fe 0.44, Secondary) | T5 | 209 | 282 | 1.8 | 70 | 110 | 17 | | 40 | 65 | 8.5 | |
| AlSi5Cu3Mg0.25Ti (Fe 0.15, Primary) | T7 | 311 | 358 | 2.5 | 92 | 111 | 16 | 60 | 47 | 62 | 30 | 26 |
| AlSi7Cu3.3MnVZrTi (without Mg, Primary) | T7 | 195 | 335 | 8.0 | 95 | 124 | 19 | | 66 | 75 | 26 | |
| AlSi7Mg0.3Ti (Fe 0.15, Primary) | T7 | 234 | 368 | 6.0 | 102 | 133 | 19 | | 63 | 77 | 26 | 31.8 |

More recent research carried out by the applicant, and not published up to now, has shown that the low cycle fatigue strength (high stresses and, consequently, small number of cycles) of this type of alloy without magnesium was definitely lower than that of the AlSi7Cu0.5Mg0.3 alloy, which is a major handicap owing to the fact that cylinder heads undergo alternating forces at very high stresses close to the yield strength, in particular because of thermal cycling related to how the engines work.

The Wöhler curves in FIGS. 1, 2 and 3 represent the fatigue strength in tension (with a fracture probability of successively 5% shown as a light line on the left, 50% as a dark line in the middle and 95% as a light line on the right) according to the number of cycles.

It definitely appears that the number of cycles to failure, for stress levels of about 250 MPa, is limited to approximately 1000 to 2000 cycles for new alloys without magnesium (FIGS. 2 and 3), whether the copper level is 3.3% or 3.8%, against at least 20,000 for the AlSi7Cu0.5Mg0.3 alloy (FIG. 1).

In high cycle fatigue, under a lower stress, about 150 MPa, the strength of the two families becomes similar, and the research published in the article of the review "Hommes et Fonderie" of February 2008 showed that the stress limits at 10 million cycles on shell test specimens were even higher for the AlSi7Cu3.5MnVZrTi alloys without magnesium, or between 123 and 138 MPa against 115 MPa for the AlSi7Cu0.5Mg0.3 alloy.

The Problem

Taking these considerations into account, it clearly appears that as regards fatigue, an obvious need is felt to greatly improve low cycle fatigue strength without degrading the high cycle fatigue strength.

Given in addition that, in future diesel engines with common rail or supercharged petrol engines, the combustion chambers of the cylinder heads, and in particular the valve bridges, will reach or even exceed 300° C., and will undergo pressures higher than in previous generations of engines, it appears that none of the known types of alloys satisfactorily provides the combination of desired properties, namely:

High yield strength from ambient temperature to 300° C.,

High low cycle fatigue strength,

High high cycle fatigue strength,

High creep strength at 300° C.,

Good ductility throughout the ambient temperature range up to 300° C. (minimum elongation of 3% at ambient temperature, 20% at 250° C. and 25% to 300° C.).

Subject of the Invention

The subject of the invention is therefore a cast part with high mechanical resistance and hot creep strength, in particular around 300° C. or even above, combined with a high yield strength at ambient temperature and high low cycle and high cycle mechanical fatigue strength, and with good ductility from ambient temperature up to 300° C., made of aluminum alloy of chemical composition, expressed in percentages by weight:

Si: 3-11%, preferably 5.0-9.0%

Fe<0.50%, preferably <0.30%, preferably still <0.19% or even 0.12%

Cu: 2.0-5.0%, preferably 2.5-4.2%, preferably still 3.0-4.0%

Mn: 0.05-0.50%, preferably 0.08-0.20%

Mg: 0.10-0.25%, preferably 0.10-0.20%

Zn: <0.30%, preferably <0.10%

Ni: <0.30%, preferably <0.10%

V: 0.05-0.19%, preferably 0.08-0.19%, preferably still 0.10-0.19%

Zr: 0.05-0.25%, preferably 0.08-0.20%

Ti: 0.01-0.25%, preferably 0.05-0.20% possibly element(s) to modify eutectics chosen from Sr (30-500 ppm), Na (20-100 ppm) and Ca (30-120 ppm), or elements to refine eutectics, Sb (0.05-0.25%), other elements <0.05% each and 0.15% in total, the rest aluminum.

DESCRIPTION OF THE INVENTION

Figure 1:
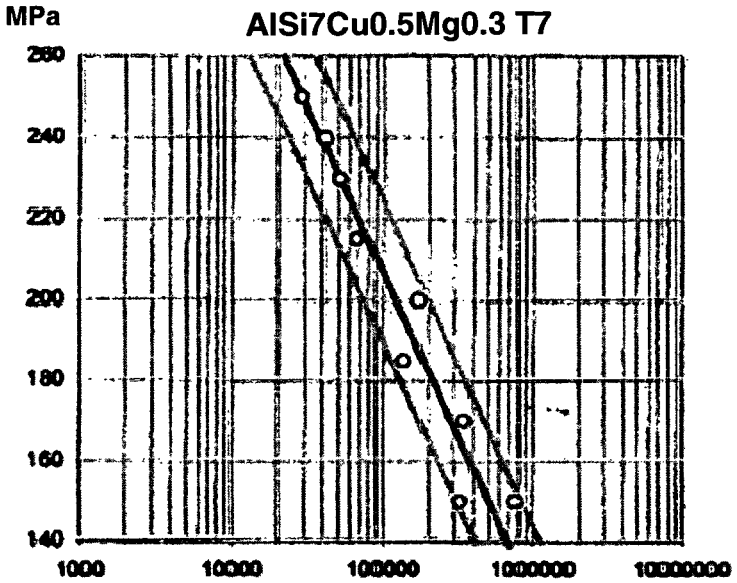
FIG. 1 shows the Wöhler curves, i.e. the fatigue strength in tension (with a fracture probability of successively 5% shown as a light line on the left, 50% as a dark line in the middle and 95% as a light line on the right) according to the number of cycles for the AlSi7Cu0.5Mg0.3 alloy.
Figure 2:
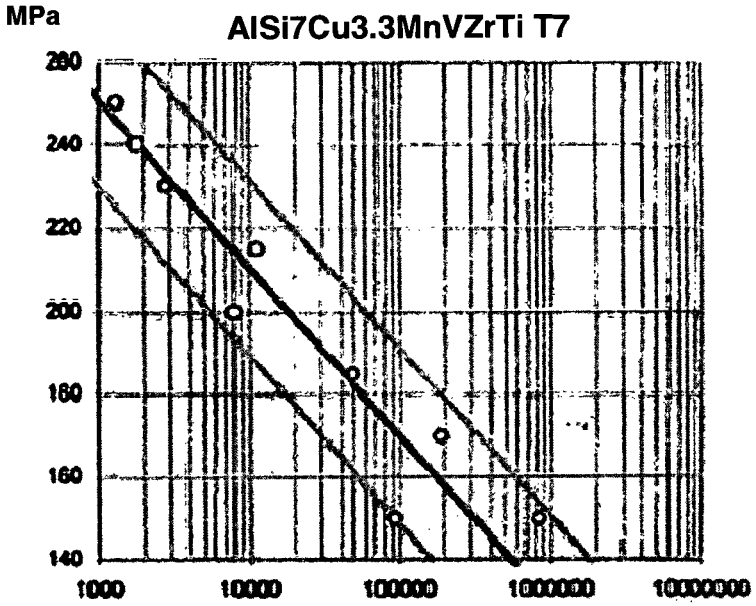
FIG. 2 shows the same curves for AlSi7Cu3.5MnVZrTi alloys without magnesium, containing 3.3% of copper.
Figure 3:
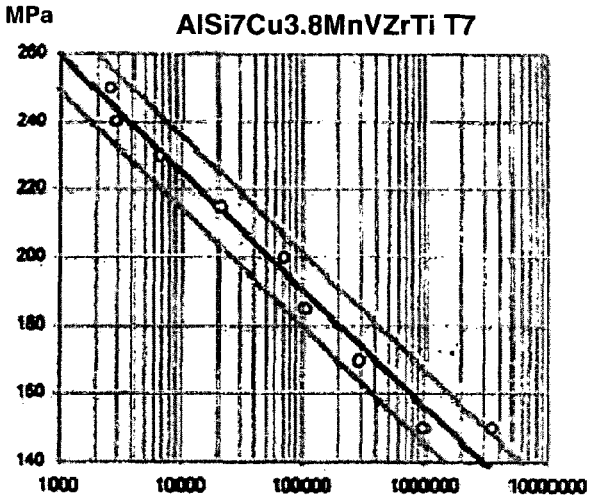
FIG. 3 shows the same curves for AlSi7Cu3.5MnVZrTi alloys without magnesium, containing 3.8% of copper.

The invention is based on the observation made by the applicant that it is possible to provide major improvements to the characteristics referred to above of the AlSi7Cu3.5MnVZrTi alloy in keeping with patents FR 2 857 378 and EP 1 651 787 by the applicant, and therefore to solve the objective problem, in two complementary ways: the addition of a small amount of magnesium and a combined vanadium-magnesium addition.

The addition of a small amount of magnesium, from 0.10 to 0.20%, makes it possible to considerably increase not only the yield strength at ambient temperature but also the low cycle fatigue strength, while preserving a satisfactory degree of elongation.

The applicant puts forth the hypothesis that this small addition of magnesium makes it possible to form a fraction of the hardening phase Q-$Al_5Mg_8Si_6Cu_2$, that is more effective on cold strength than the $Al_2Cu$ phase formed in the absence of magnesium, but that the definite predominance of copper (typically 3.5%) in relation to magnesium means that the amount of $Al_2Cu$ phase, contrastingly more effective for hot strength, is not significantly reduced by the addition of magnesium, so that the properties when hot (typically at 250 and 300° C.) are not deteriorated.

Table 2 below indicates, according to the amount of magnesium added, the quantities of hardening phases $Al_2Cu$ and Q-$Al_5Mg_8Si_6Cu_2$ formed in the AlSi7Cu3.5MnVZrTi base, at equilibrium at 200° C., after solution heat-treatment followed by quenching. The values (expressed in this case as an atomic percent) are calculated using the thermodynamic simulation software "Prophase" developed by the applicant.

TABLE 2

| | Mg (% by weight) | | | | | |
|---|---|---|---|---|---|---|
| | 0.00 | 0.05 | 0.07 | 0.10 | 0.14 | 0.19 |
| $Al_2Cu$ | 4.26 | 4.23 | 4.22 | 4.19 | 4.16 | 4.12 |
| Q-$Al_5Mg_8Si_6Cu_2$ | 0.00 | 0.15 | 0.23 | 0.35 | 0.49 | 0.67 |

As will appear in the following examples and figures which explain the results of these, in particular FIG. 4, the gain in terms of yield strength at 20° C. is substantially 100 MPa (moving from 200 to approximately 300 MPa) with an addition of only 0.10%.

So, quite unexpectedly, the effect of magnesium is absolutely not linear in the field 0 to 0.20%: it is negligible between 0 and 0.05%, intense between 0.05 and 0.10% and a plateau is then observed up to a content of substantially 0.20%.

On the other hand, also surprisingly, elongation is reduced only from 9 to 6% by this increase in the magnesium content (in the reference conditions of alloys A to K with HIP and T7 treatments, for a copper content of 3.5%).

The same absence of linearity and the plateau from 0.10 to substantially 0.20% (still in FIG. 4) are again observed.

Figure 5:
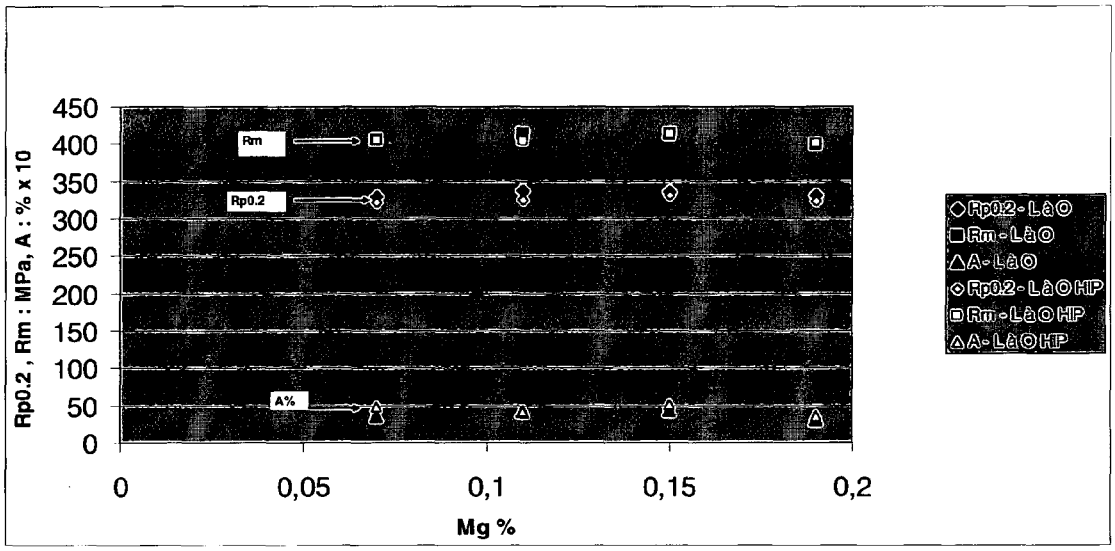
FIG. 5 corresponds to the same representation, for a copper content of 4.0%.

This same plateau, as a function of the Mg content between 0.10 and substantially 0.20%, is also observed in the case of a copper content of 4.0% as illustrated by FIG. 5.

Figure 6:
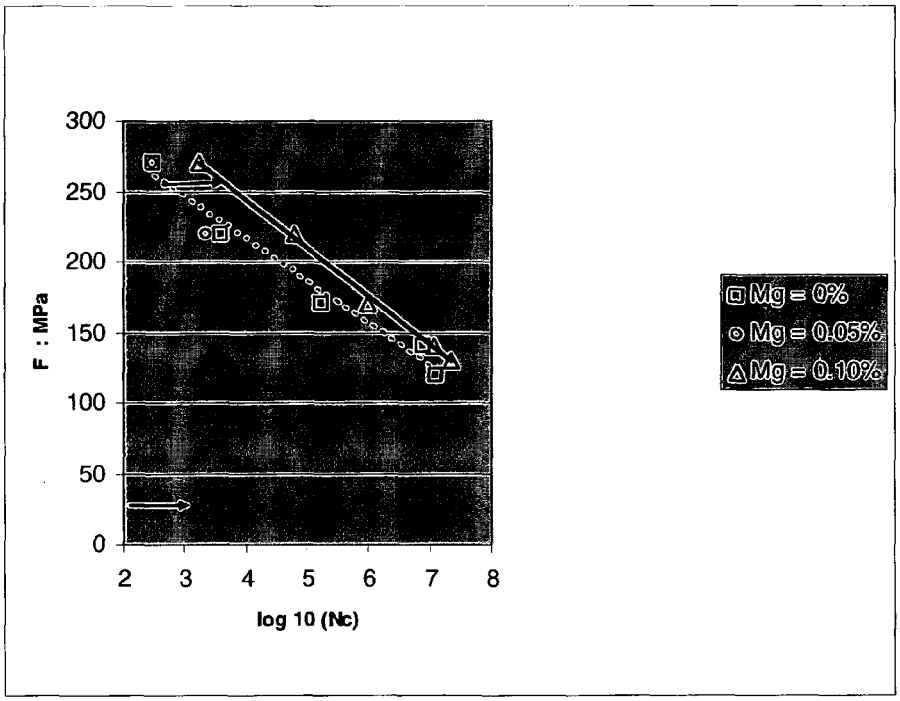
FIG. 6 shows the WMler curves, i.e. the breaking stress F at room temperature according to the number of cycles Nc (logarithmic scale), the average obtained for alloys with copper content of 3.5% tested as "examples" and according to their average Mg content of 0, 0.05 and 0.10%.

Simultaneously, the gain in low cycle fatigue strength is quite considerable as shown in FIG. 6.

For stresses of 220 and 270 MPa, the lifespan of the test specimens subjected to an alternate tension force (i.e. with a ratio R=minimum stress/maximum stress of −1) is multiplied substantially by 10 by the addition of 0.10% of magnesium.

Here too, the effect is absolutely not linear, the results for a magnesium content of 0.05% being no different from those obtained for a strictly nil content.

As regards high cycle fatigue strength (low stresses of about 120 to 140 MPa), magnesium no longer has a notable effect on the endurance limit, about 130 MPa at $10^7$ cycles, once again according to FIG. 6.

Figure 7:
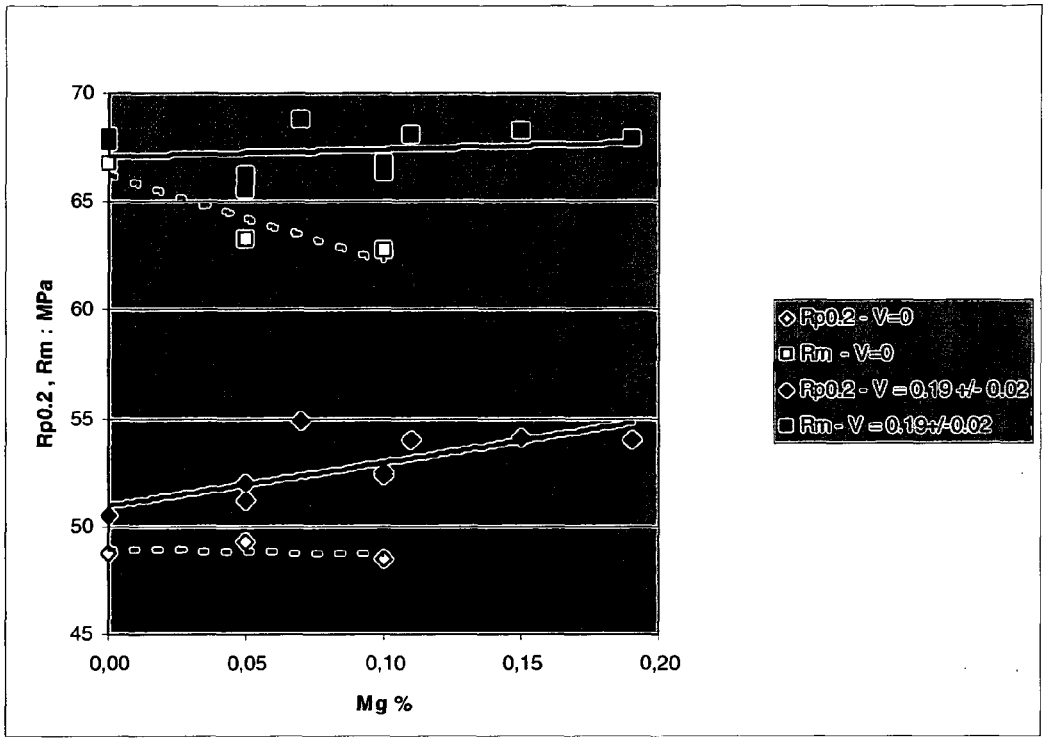
FIG. 7 shows the variation in the static mechanical characteristics Rm and $R_{p0.2}$ at 300° C. according to the magnesium content for the various alloys with copper content of 3.5% tested as "examples" and according to their vanadium content of 0 and 0.19%, in accordance with the values given in table 3.

As for the static mechanical characteristics at 250° C. and 300° C., as is illustrated in FIG. 7 in particular, relating to the characteristics at 300° C., these are only slightly modified by this addition and remain excellent. A certain gain is even to be noted in yield strength Rp0.2 at 300° C. without any loss of elongation.

In the case of parts for which cold elongation is not critical, contents up to 0.45% can be tolerated, while, to preserve a certain cold ductility, up to 0.25%, and better still 0.20% can be allowed.

Figure 9:
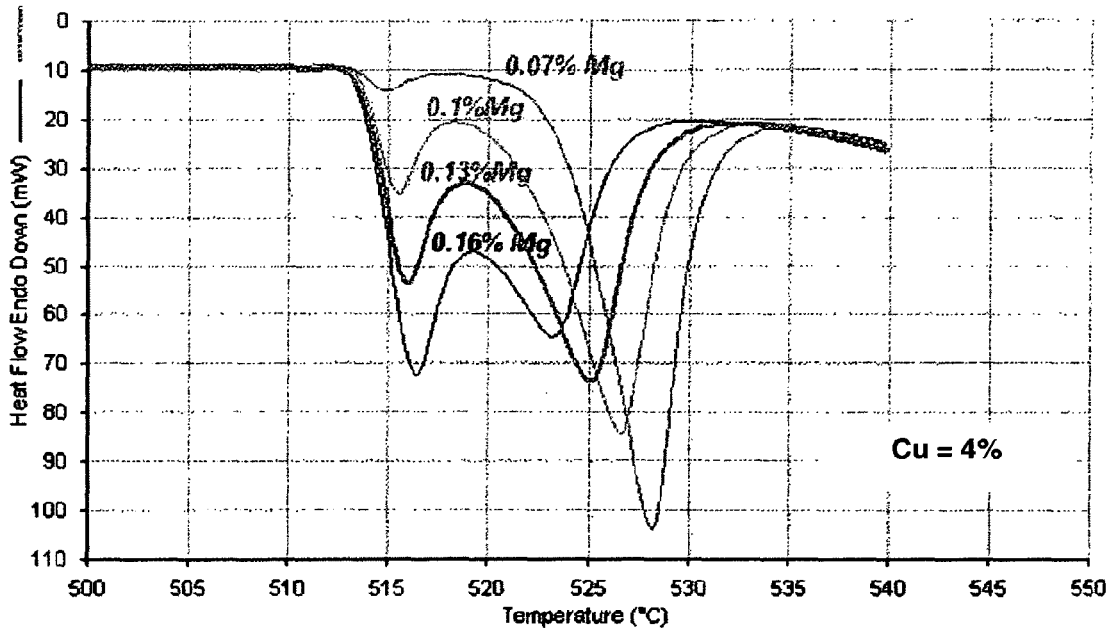
FIG. 9 shows the differential enthalpic analysis curves for the alloys AlSi7Cu3.5MnVZrTi (bottom curves) and AlSi7Cu4.0MnVZrTi (top curves) and for various magnesium contents, from 0.07 to 0.16%.
Figure 9:
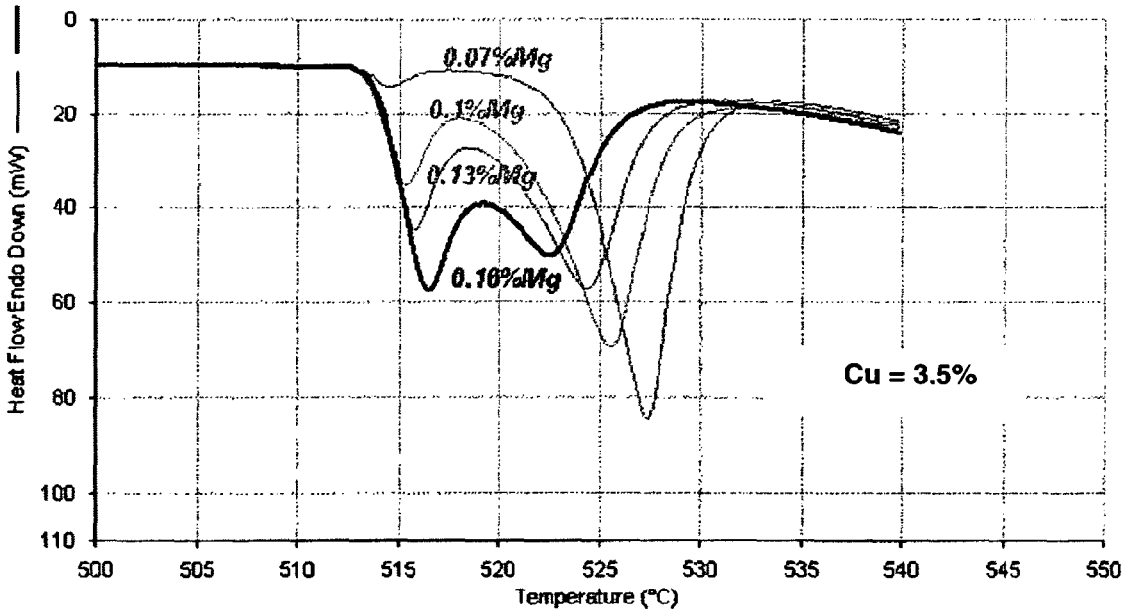

Finally, the alloys of type AlSi5Cu3 and AlSi7Cu3 according to the invention, with a relatively low magnesium content, or up to substantially 0.20%, unlike alloys with a higher magnesium content, typically from 0.25 to 0.45%, do not have the final quaternary eutectic Al—Si—$Al_2Cu$—$Al_5Mg_8Si_6Cu_2$, melting at 507° C. according to the phase diagrams by H.W.L. Philips (Equilibrium Diagrams of Aluminum Alloy Systems. The Aluminium Development Association Information Bulletin 25. London.1961) or at 508° C. according to other authors. Their initial melting point, determined by differential enthalpic analysis (DEA) is substantially 513° C., as shown in FIG. 9.

This makes it possible to apply a solution heat-treatment at 505° C., typically between 500 and 513° C., without risk of burning, with standard heat treatment equipment, whereas the alloys of prior art are treated at 500° C. at the most, and at 495° C. in general.

But a second component of this invention lies in combining an addition of vanadium with the above-mentioned addition of magnesium:

Quite surprisingly, the applicant observed the existence of a strong interaction between magnesium and vanadium on yield strength and an even greater one on creep strength at 300° C.

Indeed, as is known, these two elements do not act by means of absolutely the same metallurgical mechanism and these mechanisms in fact act in completely opposite ways.

On the one hand, magnesium, a eutectic element with a strong diffusion coefficient, takes part in structural hardening after aging, through the formation of coherent intermetallic phases with the aluminum matrix, in fact via phase Q mentioned above, but it gradually loses its hardening effect by coalescence of said phase at 300° C. and above.

On the other hand, and conversely, vanadium, a peritectic element with a very low diffusion coefficient, is present in a solid solution enriched in the dendrite cores and may possibly precipitate in the form of only semi-coherent dispersoids Al—V—Si which remain stable at temperatures greater than 400° C.

The results of the examples show, however, that the alloys combining a magnesium content of 0.10 to 0.19% and a vanadium content of 0.17, 0.19 or 0.21% resist considerably better than those which contain only vanadium or only magnesium. This is illustrated perfectly by FIG. 7, concerning the static mechanical characteristics, and FIG. 8, for the creep strength.

Adding more than 0.21% of vanadium is possible and is just as beneficial for creep strength, but the solubility of vanadium in liquid alloy is limited.

The applicant carried out in-depth tests to determine the solubility of vanadium according to the temperature of the molten metal bath, in an alloy according to the invention, of the AlSi7Cu3.5MgMn0.30Zr0.20Ti0.20 type initially containing 0.28% of vanadium introduced and solubilized at 780° C.

Figure 10:
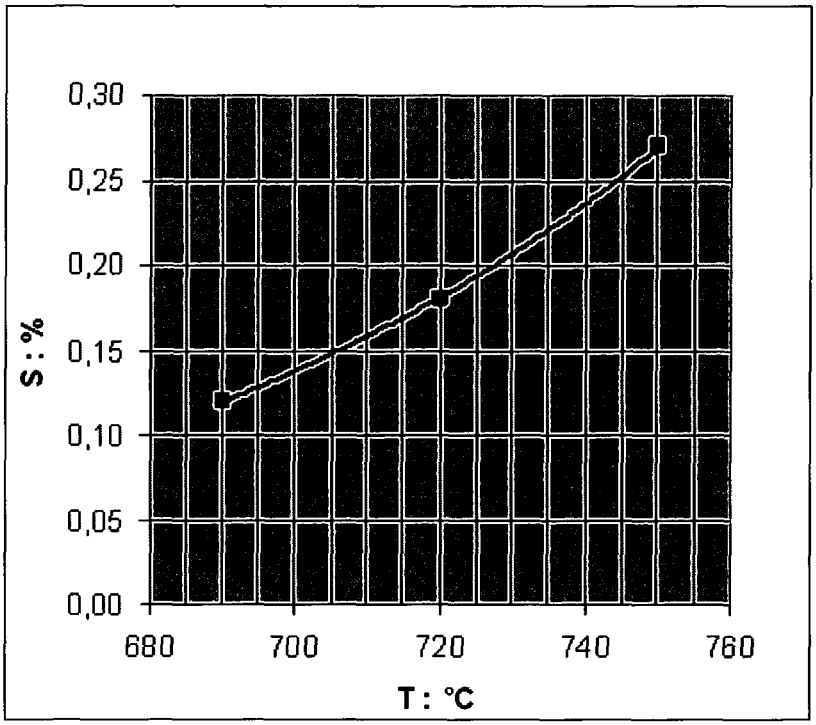
FIG. 10 shows the solubility S of vanadium at equilibrium according to the temperature T of alloy bath AlSi7Cu3.5MgMn0.30Zr0.20TiO.20 comprising an initial vanadium content of 0.28% introduced and solubilized at 780° C.

Solubility at equilibrium according to the holding temperature of the bath is shown in FIG. 10.

It is noted from this that, to maintain in solution a level of 0.25% of vanadium, the bath must be maintained at a temperature of at least 745° C., i.e. a relatively high value for shell-mold (permanent metal mould) casting of cylinder heads by gravity or at low pressure.

Levels of 0.21%, and still better 0.17%, allow the bath to be maintained at 730 or 720° C., which is much more compatible with said casting processes.

As no reduction in creep strength is observed when the vanadium content is reduced from 0.21 to 0.17%, an additional reduction in the amount vanadium is very much a possibility: to cast the parts under consideration using the "low pressure" process in which the temperature of the bath may be only 680° C., a vanadium content from 0.08 to 0.10% is to be adopted (FIG. 10). For parts cast "under pressure" that are heat treatable, for example in a vacuum, the conventional holding temperatures of this process are still lower than 680° C. and a vanadium content of 0.05% is then conceivable.

Concerning the other elements making up the type of alloy according to the invention, their contents are justified by the following considerations:

Silicon: this is essential to obtain good foundry properties, such as fluidity, absence of hot tearing, and proper feeding of the shrinkage cavities.

For a content lower than 3%, these properties are insufficient for shell-mold casting whereas for contents above 11% the shrinkage pipe is too concentrated and elongation too low.

In addition, a compromise generally considered as optimum between these properties and ductility ranges between 5 and 9%. This range corresponds to the majority of the applications of the internal combustion engine cylinder head type.

Iron: It is well-known that this element significantly reduces the elongation of alloys of the Al—Si type. The examples described below confirm this in the case of the invention.

Depending on the type of thermo-mechanical stress undergone by each particular part model, an appropriate level of iron tolerance can be chosen, knowing that "high purity", in particular with regard to iron, is a factor impacting cost. For parts for which cold elongation is not critical, contents up to 0.50% can be tolerated, while, to preserve a certain cold ductility, contents up to 0.30% may be allowed, and for parts undergoing a great amount of stress including for cold working, a maximum of 0.19% is to be preferred, a level specified by French standard EN 1706 for alloys with high characteristics EN AC-21100, 42100, 42200 and 44000, and better still 0.12%.

Copper: The copper content of such heat-resistant alloys is conventionally in the range of 2 to 5%. Preferably, the range between 2.5%, to ensure a sufficiently high yield strength and elevated temperature strength, and 4.2%, the approximate solubility limit of copper in a base containing from 4.5 to 10% of silicon and up to 0.25% of magnesium, will be chosen, with solution heat-treatment at a temperature lower than or equal to 513° C.

Figure 4:
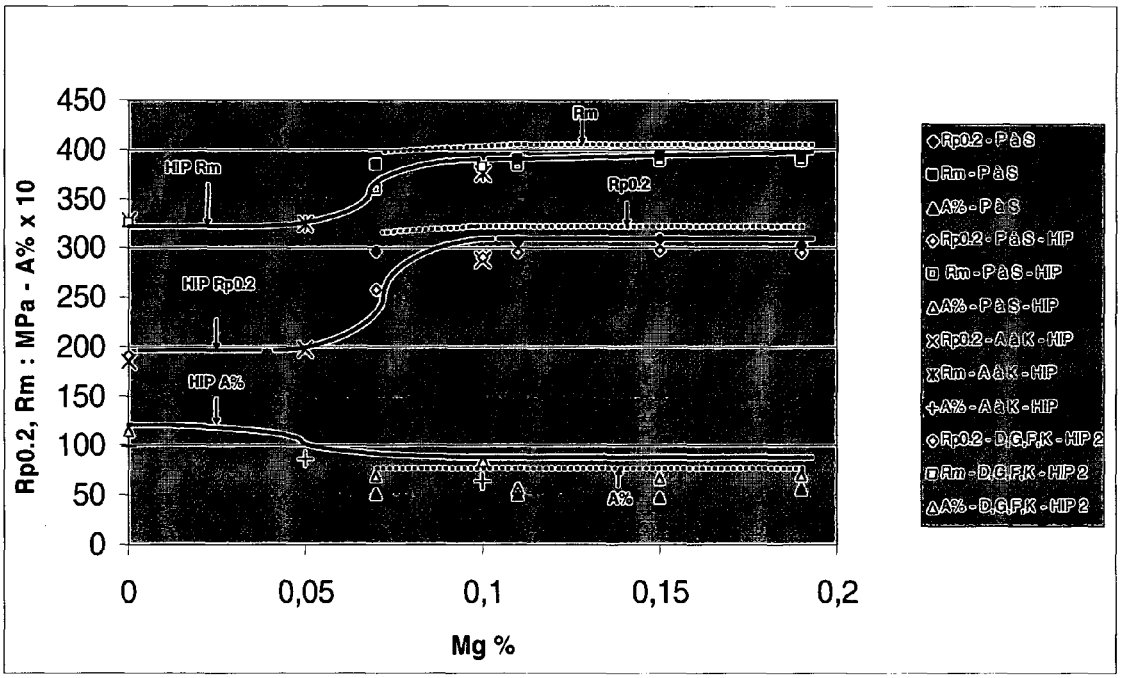
FIG. 4 shows the variation in the static mechanical characteristics, Rm, $R_{p0.2}$ and A %, at ambient temperature according to the magnesium content for the various alloys with copper content of 3.5% tested as "examples", the key to the reference marks appearing on the right of the figure according to indices A to T in accordance with table 3. The series of results $R_{p0.2}$ Rm and A % notated "A to K HIP 2" correspond to the complementary tests at the bottom of table 3.

The examples described below show that increasing the copper content from 3.5 to 4.0% results in a gain of about 30 MPa in terms of yield strength and 15 MPa for ultimate tensile strength, but also in a loss of 1% for elongation, as a comparison between FIGS. 4 and 5 shows. Taking into account these results and the need, in the case of cylinder heads undergoing a great amount of stress, for a good compromise between strength and ductility, the most suitable range for copper seems to be 3 to 4%.

Manganese: From previous research described in the above-mentioned article, published in "Hommes et Fonderie" of February 2008, the applicant has already identified that a manganese content from 0.08 to 0.20% improved the effect of zirconium on creep strength at 300° C.

In addition, on the assumption of a fairly high iron content, about 0.30% and better still 0.50%, the addition of up to 0.50% of manganese makes it possible to convert the acicular and embrittling $Al_5FeSi$ phase into a so-called "Chinese script" quaternary and less embrittling $Al_5(Fe,Mn)Si_2$ phase.

Zinc: If it is chosen to use the variant with a high iron content, up to 0.50%, it is necessary, in order to capitalize on this choice, to also tolerate a zinc content of up to 0.30%. In the preferred case where an alloy with high iron purity, of primary origin, is used the zinc content can advantageously be limited to 0.10%.

Nickel: as with zinc, this element, which quite substantially reduces elongation, can be tolerated at a content of up to 0.30% in an alloy with an iron content of up to 0.50%, but it will preferably be limited to 0.10% when high ductility is required.

Zirconium: during prior research the applicant has already identified the positive effect of zirconium on creep strength when hot through the formation of stable dispersoid phases of the AlSiZrTi type.

This effect is particularly underlined in patents FR 2 841 164 and FR 2 857 378 by the applicant which claim a range of 0.05 to 0.25% and, in the second, preferably 0.12 to 0.20%. A content ranging from 0.08 to 0.20% is a balanced compromise, given that too high a content, about 0.25%, leads to coarse and embrittling primary phases, and that too low a content proves insufficient as regards creep strength.

Titanium: this element acts according to two joint modes: it helps refining of the primary aluminum grain, and also contributes to creep strength, as identified in patent FR 2 841 164, taking part in the formation of dispersoid AlSiZrTi phases.

These two objectives are simultaneously attained for contents ranging between 0.01 and 0.25%, and preferably between 0.05 and 0.20%.

Elements that modify or refine the Aluminum-Silicon eutectic: Eutectic modification is generally desirable in order to improve the elongation of Al—Si alloys.

This modification is obtained by the addition of one or more of the elements strontium (from 30 to 500 ppm), sodium (from 20 to 100 ppm) or calcium (from 30 to 120 ppm). Another way of refining the AlSi eutectic is to add antimony (from 0.05 to 0.25%).

Heat treatment: cast parts according to the invention are generally subjected to heat treatment comprising solution heat-treatment, quenching and aging.

In the case of internal combustion engine cylinder heads, treatment of the T7 type is generally used, including overageing which has the advantage of stabilizing the part.

But for other applications, in particular an insert for a hot part of a cast part, T6 type treatment is also possible.

The details of the invention will be understood better with the help of the examples below, which are not however restrictive in their scope.

EXAMPLES

In a 120 kg electric furnace with a silicon carbide crucible a series of aluminum alloys was produced and cast in the form of test specimens (rough shell-mold test specimens of 18 mm as per French standard AFNOR NF-A57702). These alloys have the following compositions:

Si: 7%

Fe: 0.10% except cast T at 0.19%

Cu: two levels 3.5% and 4%, see table 3 below

Mn: 0.15%

Mg: varying from 0 to 0.19%, see table 3

Zn <0.05%

Ti: 0.14%

V: four levels 0.00%, 0.17%, 0.19% and 0.21%, see table 3

Zr: 0.14%

Sr: 50 to 100 ppm.

Some of the test specimens cast underwent hot isostatic pressing (known to specialists by the name of "HIP"), for 2 hours at 485° C. (+/−10° C.) and 1000 bar.

All the test specimens then underwent T7 heat treatment appropriate for their composition, namely:

Solution heat treatment for 10 hours at 515° C. for alloys without magnesium (casts, A, D and G) and for 10 hours at 505° C. for alloys containing 0.05% to 0.19% of magnesium (casts B, C, E, F, H, K and L to T).

Water quenching at 20° C.

Ageing for 5 hours at 220° C. for alloys without magnesium (casts A, D and G), for 4 hours at 210° C. for alloys B, C, E, F, H, K and for 5 hours at 200° C. for alloys L to T.

Casts D, G, F and K were further characterized at ambient temperature with only one heat treatment for 10 hours at 515° C. for D and G without magnesium and for 10 hours at 505° C. for F and K with 0.10% of magnesium, followed for the four casts by water quenching at 20° C. and 5 hours ageing at 200° C. so as to be more directly comparable with casts L to T.

In another heat treatment variant, the solution heat-treatment of alloys L to T is shortened to 5 hours instead of 10 hours.

The static mechanical characteristics were measured in the following conditions:

at ambient temperature, in the case of the AFNOR test specimen previously mentioned, machined to 13.8 mm, elongation measurement basis 69 mm, in the conditions laid down in standard EN 10002-1.

at 250 and 300° C., the test specimens being taken from the same AFNOR shell blanks of diameter 18 mm, then machined to the diameter of 8 mm and previously preheated for 100 hours to the temperature under consideration so that the bulk of the structural change is achieved, then stretched at 250 or 300° C. in the conditions laid down in standard EN 10002-5.

Mechanical fatigue strength at ambient temperature was measured in tension-compression, with a ratio R (mini/max stress) of −1 for round test specimens of diameter 5 mm, also machined from AFNOR shell blanks.

The creep tests at 300° C. were carried out on test specimens machined to a diameter of 4 mm from the same AFNOR blanks, preheated at 300° C. for 100 hours before the test itself.

This involved subjecting the test specimen to a constant stress equal to 30 MPa for up to 300 hours and recording bending A as a percentage of the test specimen. It is obvious that the lower this bending, the better is the creep strength of the alloy. The test specimens cast from the alloy which gave the lowest creep result, or composition C without vanadium, in fact broke well before 300 hours, with bending at break ranging between 2.4 and 4%, which are shown by the rectangle R in FIG. 8.

The results of the tensile tests at 20, 250 and 300° C. are indicated in table 3 (tensile strength Rm in MPa, yield strength $R_{p0.2}$ in MPa and elongation at break A as a percentage) for the alloys whose composition is also shown in table 3, those of the fatigue tests at ambient temperature in table 4 (stresses F in MPa), and those of the creep tests in table 5 (elongation A as a percentage according to the holding time H at 300° C., from 0 to 300 hours, at 30 MPa).

They are easier to interpret with the help of the curves of FIGS. 4 to 8:

Concerning the static mechanical characteristics (FIG. 4) and the mechanical fatigue strength at ambient temperature (FIG. 6), for alloys with a copper content of 3.5%, the intense and nonlinear effect of magnesium can very clearly be seen.

While practically nil between 0 and 0.05%, it is very strong between 0.05 and 0.10%. The yield strength then increases by substantially 100 MPa while the low cycle fatigue life in the field ranging from 220 to 270 MPa is multiplied by almost 10.

From 0.10% to 0.19%, a completely unexpected plateau of static mechanical characteristics at ambient temperature is then observed.

As could be expected, vanadium does not in contrast have any notable effect on these two properties measured at ambient temperature.

The increase in the copper content from 3.5 to 4.0% results in a gain of about 30 MPa for the yield strength and 15 MPa for ultimate tensile strength, but also in a loss of 1% for elongation, as comparison between FIGS. 4 and 5 shows.

As regards the mechanical characteristics at 300° C., a particular objective of the new type of alloy according to the invention, it can be noted from table 3 that ductility is very high (greater than 25% for all cases with solution heat-treatment of 10 hours).

FIG. 7 additionally indicates that joint additions of magnesium at a rate of between 0.07 and 0.19% and vanadium at a rate of between 0.17 and 0.21% make it possible to improve the yield strength by substantially 8%.

As regards creep strength at 300° C., the results, in table 5, are even more divergent:

Alloy C containing 0.10% of magnesium, but without vanadium, does not last for 300 hours at 300° C. and 30 MPa; it breaks between 150 and 200 hours with bending ranging between 2.4 and 4%;

Alloy G, without magnesium, but containing 0.21% of vanadium, lasts for 300 hours, but shows final average bending of 2.83%;

Alloys F and K, both containing 0.10% of magnesium, and the first 0.17% of vanadium and the second 0.21%, have virtually identical behavior, performing much better than G and C; no break is noted, average bending is only 0.60 and 0.54%, which is not significantly different taking into account the discrepancy between test specimens.

Figure 8:
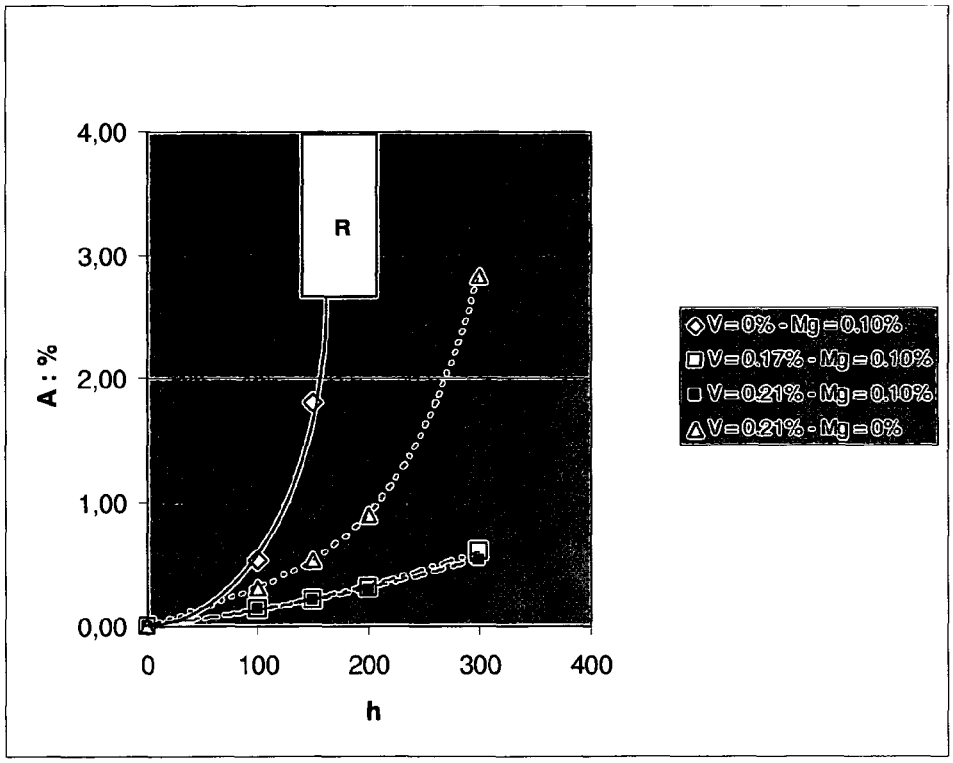
FIG. 8 sums up the results of the creep tests at 300° C. given in table 5, namely bending as a percentage obtained with a stress of 30 MPa according to time h of the test from 0 to 300 hours, and for various magnesium and vanadium contents indicated on the right of the figure. R shows the breaking zone which occurs before 300 hours only in the case of the composition V=0, Mg=0.10%.

FIG. 8 makes it possible to better visualize the scale of the interaction between vanadium and magnesium on creep strength at 300° C.

The results of these tests also show that the "HIP" treatment, which reduces or destroys microporosity, certainly improves elongation because of this, by approximately 1% at ambient temperature, but also slightly "softens" the alloys; the yield strengths are systematically lower, as FIGS. 4 and 5 show, particularly for a magnesium content of 0.07% in the vicinity of the bend in the curve.

The increase in the iron content from 0.10% to 0.19% reduces elongation at ambient temperature by approximately 30% as a relative value, with or without "HIP" treatment;

this appears clearly by comparing the level of the plateau for a magnesium content of 0.11 to 0.19% of alloys Q-R-S with that of alloy T in Table 3. At 250 and 300° C., the effect of this same increase becomes negligible, however.

The reduction of solution heat-treatment time from 10 to 5 hours does not notably affect the characteristics of alloys M-NR—O either, even though these are highly charged with copper, characteristics which correspond to the plateau of FIG. 5. A more drastic reduction, down to half an hour, is conceivable, in particular because of the possibilities offered by the solution heat treatment in a fluidized bed.

TABLE 3

COMPOSITIONS & MECHANICAL CHARACTERISTICS OF THE ALLOYS EXAMINED

| Alloy | Heat Treatment | Properties at 20° C. Rp0.2 | Rm | A % | Properties at 250° C. Rp0.2 | Rm | A % | Properties at 300° C. Rp0.2 | Rm | A % | Cu | Mg | V | Fe |
|---|---|---|---|---|---|---|---|---|---|---|---|---|---|---|
| A | HIP + T7 (10 h) | 187 | 334 | 10.1 | 81 | 112 | 25 | 49 | 67 | 33 | 3.5 | 0.00 | 0.00 | 0.10 |
| B | " | 222 | 337 | 7.4 | 81 | 104 | 27 | 49 | 63 | 41 | 3.5 | 0.05 | 0.00 | 0.10 |
| C | " | 285 | 379 | 6.4 | 88 | 107 | 30 | 49 | 63 | 47 | 3.5 | 0.10 | 0.00 | 0.10 |
| D | " | 191 | 333 | 9.3 | 81 | 109 | 24 | 51 | 68 | 33 | 3.5 | 0.00 | 0.17 | 0.10 |
| E | " | 194 | 323 | 8.9 | 84 | 107 | 25 | 52 | 66 | 47 | 3.5 | 0.05 | 0.17 | 0.10 |
| F | " | 290 | 375 | 5.5 | 86 | 106 | 30 | 53 | 67 | 41 | 3.5 | 0.10 | 0.17 | 0.10 |
| G | " | 179 | 324 | 10.4 | 80 | 110 | 25 | 51 | 68 | 29 | 3.5 | 0.00 | 0.21 | 0.10 |
| H | " | 200 | 325 | 8.5 | 83 | 107 | 26 | 51 | 66 | 42 | 3.5 | 0.05 | 0.21 | 0.10 |
| K | " | 285 | 377 | 7.4 | 85 | 104 | 25 | 52 | 66 | 34 | 3.5 | 0.10 | 0.21 | 0.10 |
| L | " | 321 | 405 | 4.8 | | | | | | | 4.0 | 0.07 | 0.19 | 0.10 |
| M | " | 324 | 404 | 4.2 | | | | | | | 4.0 | 0.11 | 0.19 | 0.10 |
| N | " | 331 | 413 | 5.1 | | | | | | | 4.0 | 0.15 | 0.19 | 0.10 |
| O | " | 323 | 400 | 3.5 | | | | | | | 4.0 | 0.19 | 0.19 | 0.10 |
| P | " | 258 | 359 | 6.9 | | | | | | | 3.5 | 0.07 | 0.19 | 0.10 |
| Q | " | 296 | 383 | 5.6 | | | | | | | 3.5 | 0.11 | 0.19 | 0.10 |
| R | " | 298 | 389 | 6.7 | | | | | | | 3.5 | 0.15 | 0.19 | 0.10 |
| S | " | 296 | 389 | 7 | | | | | | | 3.5 | 0.19 | 0.19 | 0.10 |
| T | " | 296 | 384 | 5 | | | | | | | 3.5 | 0.13 | 0.19 | 0.19 |
| L | T7 (10 h) | 330 | 405 | 3.6 | 94 | 116 | 24 | 53 | 66 | 33 | 4.0 | 0.07 | 0.19 | 0.10 |
| M | " | 337 | 413 | 4.2 | 96 | 117 | 24 | 55 | 69 | 32 | 4.0 | 0.11 | 0.19 | 0.10 |
| N | " | 336 | 413 | 4.3 | | | | 54 | 68 | 29 | 4.0 | 0.15 | 0.19 | 0.10 |
| O | " | 331 | 399 | 3.1 | 100 | 120 | 21 | 54 | 62 | 36 | 4.0 | 0.19 | 0.19 | 0.10 |
| P | " | 297 | 385 | 5.2 | | | | 55 | 69 | 40 | 3.5 | 0.07 | 0.19 | 0.10 |
| Q | " | 307 | 390 | 5 | 96 | 114 | 21 | 54 | 68 | 31 | 3.5 | 0.11 | 0.19 | 0.10 |
| R | " | 309 | 393 | 4.8 | 97 | 116 | 24 | 54 | 68 | 35 | 3.5 | 0.15 | 0.19 | 0.10 |
| S | " | 303 | 392 | 5.7 | 97 | 114 | 16 | 54 | 68 | 38 | 3.5 | 0.19 | 0.19 | 0.10 |
| T | " | 305 | 377 | 3.2 | 93 | 113 | 21 | 50 | 64 | 39 | 3.5 | 0.13 | 0.19 | 0.19 |
| L | T7 (5 h) | 317 | 397 | 3.4 | 97 | 121 | 27 | 58 | 73 | 24 | 4.0 | 0.07 | 0.19 | 0.10 |
| M | " | 340 | 414 | 4 | 97 | 119 | 27 | 58 | 72 | 23 | 4.0 | 0.11 | 0.19 | 0.10 |
| N | " | 336 | 408 | 3.5 | 99 | 119 | 23 | 59 | 74 | 31 | 4.0 | 0.15 | 0.19 | 0.10 |
| O | " | 339 | 405 | 2.9 | 101 | 121 | 20 | 58 | 73 | 34 | 4.0 | 0.19 | 0.19 | 0.10 |
| Further tests on casts D and G, and on F and K with ageing of 5 hours at 200° C. | | | | | | | | | | | | | | |
| Average of D&G | HIP + T7(10 h) | 178 | 330 | 14.2 | | | | | | | 3.5 | 0.00 | 0.17 & 0.21 | 0.10 |
| Average of F&K | " | 290 | 383 | 8.42 | | | | | | | 3.5 | 0.10 | 0.17 & 0.21 | 0.10 |

TABLE 4

| Mg % | Alloy | Stress F | Number of cycles Nc | Broken C or not NC |
|---|---|---|---|---|
| 0 | A | 270 | 245 | C |
| 0 | D | 270 | 305 | C |
| 0 | G | 270 | 389 | C |
| 0 | A | 220 | 1 526 | C |
| 0 | A | 220 | 6 352 | C |
| 0 | D | 220 | 3 690 | C |
| 0 | D | 220 | 4 436 | C |
| 0 | G | 220 | 5 779 | C |
| 0 | G | 220 | 3 790 | C |
| 0 | A | 170 | 61 584 | C |
| 0 | A | 170 | 2 600 | C |
| 0 | D | 170 | 1 020 800 | C |
| 0 | D | 170 | 817 139 | C |

TABLE 4-continued

| Mg % | Alloy | Stress F | Number of cycles Nc | Broken C or not NC |
|---|---|---|---|---|
| 0 | G | 170 | 415 179 | C |
| 0 | G | 170 | 538 994 | C |
| 0 | D | 140 | 7 558 273 | C |
| 0 | G | 120 | 12 447 392 | NC |
| 0.05 | H | 270 | 303 | C |
| 0.05 | H | 220 | 2 297 | C |
| 0.10 | C | 270 | 3 175 | C |

TABLE 4-continued

| Mg % | Alloy | Stress F | Number of cycles Nc | Broken C or not NC |
|---|---|---|---|---|
| 0.10 | F | 270 | 1 165 | C |
| 0.10 | K | 270 | 1 522 | C |
| 0.10 | K | 270 | 1 415 | C |
| 0.10 | C | 220 | 70 233 | C |
| 0.10 | C | 220 | 47 579 | C |
| 0.10 | F | 220 | 95 248 | C |
| 0.10 | F | 220 | 13 166 | C |
| 0.10 | K | 220 | 347 036 | C |
| 0.10 | K | 220 | 39 025 | C |
| 0.10 | C | 170 | 3 154 045 | C |
| 0.10 | C | 170 | 402 481 | C |
| 0.10 | F | 170 | 2 813 763 | C |
| 0.10 | F | 170 | 355 009 | C |

TABLE 4-continued

| Mg % | Alloy | Stress F | Number of cycles Nc | Broken C or not NC |
|---|---|---|---|---|
| 0.10 | K | 170 | 431 101 | C |
| 0.10 | K | 170 | 880 016 | C |
| 0.10 | K | 170 | 2 026 665 | C |
| 0.10 | C | 140 | 11 459 025 | C |
| 0.10 | K | 130 | 21 156 603 | NC |

TABLE 5

| Alloy | Mg % | V % | A-0 h | A-100 h | A-100 h Av. | A-150 h | A-150 h Av. | A-200 h | A-200 h Av. | A-300 h | A-300 h Av. |
|---|---|---|---|---|---|---|---|---|---|---|---|
| C | 0.10 | 0 | 0 | 0.8 | | 3.3 | | Break at 156 h, A = 3.8% | | | |
| | " | " | 0 | 0.5 | 0.53 | 1,.3 | 1.80 | Break at 175 h, A = 2.4% | | | |
| | " | " | 0 | 0.3 | | 0.80 | | Break at 185 h, A = 4% | | | |
| G | 0.00 | 0.21 | 0 | 0.27 | 0.31 | 0.46 | 0.53 | 0.74 | 0.90 | 1.92 | 2.83 |
| | " | " | 0 | 0.35 | | 0.60 | | 1.05 | | 3.73 | |
| F | 0.10 | 0.17 | 0 | 0.17 | | 0.26 | | 0.40 | | 0.88 | |
| | " | " | 0 | 0.15 | 0.15 | 0.22 | 0.22 | 0.30 | 0.31 | 0.59 | 0.60 |
| | " | " | 0 | 0.12 | | 0.17 | | 0.22 | | 0.33 | |
| K | 0.10 | 0,.21 | 0 | 0.14 | | 0.22 | | 0.32 | | 0.58 | |
| | " | " | 0 | 0.14 | 0.13 | 0.21 | 0.20 | 0.31 | 0.30 | 0.58 | 0.54 |
| | " | " | 0 | 0.12 | | 0.18 | | 0.26 | | 0.45 | |

The invention claimed is:

1. Cast part made of aluminum alloy of chemical composition, expressed in percentages by weight, consisting essentially of:

Si: at least 3% and less than 9%

Fe<0.50%

Cu: 2.0-5.0%

Mn: 0.05-0.50%

Mg: 0.10-0.19%

Zn: <0.30%

Ni: <0.10%

V: 0.05-0.19%

Zr: 0.05-0.25%

Ti: 0.01-0.25% optionally one or more elements to modify eutectics chosen from Sr (30-500 ppm), Na (20-100 ppm) and Ca (30-120 ppm), or Sb (0.05-0.25%) to refine eutectics, and other elements <0.05% each and 0.15% in total, the rest aluminum, wherein the cast part is an automotive engine component, and wherein the cast part has a microstructure that includes one or both of an $Al_5FeSi$ phase and an $Al_5(Fe,Mn)Si_2$ phase.

2. Cast part according to claim 1, characterized in that the silicon content of the alloy is at least 5.0% and less than 9.0%.

3. Cast part according to claim 1 characterized in that the vanadium content lies between 0.08 and 0.19%.

4. Cast part according to claim 1, characterized in that the iron content is lower than 0.30%.

5. Cast part according to claim 1 characterized in that the copper content lies between 2.5 and 4.2%.

6. Cast part according to claim 1 characterized in that the manganese content lies between 0.08 and 0.20%.

7. Cast part according to claim 1, characterized in that the zinc content is lower than 0.10%.

8. Cast part according to claim 1 characterized in that the zirconium content lies between 0.08 and 0.20%.

9. Cast part according to claim 1 characterized in that the titanium content lies between 0.05 and 0.20%.

10. Cast part according to claim 1, characterized in that the iron content is lower than 0.19%.

11. Cast part according to claim 1, characterized in that the iron content is lower than 0.12%.

12. Cast part according to claim 1 characterized in that the copper content lies between 3.0 and 4.0%.

13. Cast part according to claim 1 characterized in that the vanadium content lies between 0.10 and 0.19%.

14. Cast part according to claim 1 characterized in that the cast part undergoes heat treatment of type T7 or T6.

15. Cast part according to claim 1, characterized in that the cast part undergoes heat treatment of type T7 or T6 comprising solution heat-treatment at a temperature ranging between 500 and 513° C. for at least 30 minutes.

16. Cast part according to claim 1, characterized in that the cast part is a cylinder head of an internal combustion engine.

17. Cast part according to claim 1, characterized in that the cast part is an insert for a hot part of a cast part.

18. Cast part made of aluminum alloy of chemical composition, expressed in percentages by weight, consisting essentially of:

Si: at least 3% and less than 9%

Fe<0.50%

Cu: 2.0-5.0%

Mn: 0.05-0.50%

Mg: 0.10-0.19%

Zn: <0.30%

Ni: <0.10%

V: 0.05-0.17%

Zr: 0.05-0.25%

Ti: 0.01-0.25% optionally one or more elements to modify eutectics chosen from Sr (30-500 ppm), Na (20-100 ppm) and Ca (30-120 ppm), or Sb (0.05-0.25%) to refine eutectics, and other elements <0.05% each and 0.15% in total, the rest aluminum, wherein the cast part is an automotive engine component, and wherein the cast part has a microstructure that includes one or both of an $Al_5FeSi$ phase and an $Al_5(Fe,Mn)Si_2$ phase.

19. Cast part according to claim 18 characterized in that the vanadium content lies between 0.08 and 0.17%.

20. Cast part according to claim 1, characterized in that the alloy has a yield strength of at least 285 MPa at 20° C., at least 86 MPa at 250° C., and at least 50 MPa at 300° C.

21. Cast part according to claim 1, characterized in that the alloy has a yield strength of at least 285 MPa at 20° C.

22. Cast part according to claim 1, characterized in that the alloy has a yield strength of at least 285 MPa at 20° C., and at least 86 MPa at 250° C.

23. Cast part according to claim 1, characterized in that the alloy has a yield strength of at least 285 MPa at 20° C., and at least 50 MPa at 300° C.

24. Cast part made of aluminum alloy of chemical composition, expressed in percentages by weight, consisting essentially of:

Si: at least 3% and less than 9%
Fe<0.50%
Cu: 2.0-5.0%
Mn: 0.05-0.50%
Mg: 0.10-0.25%
Zn: <0.30%
Ni: <0.10%
V: 0.05-0.19%
Zr: 0.05-0.25%
Ti: 0.01-0.25%
optionally one or more elements to modify eutectics chosen from Sr (30-500 ppm), Na (20-100 ppm) and Ca (30-120 ppm), or Sb (0.05-0.25%) to refine eutectics, and
other elements <0.05% each and 0.15% in total, the rest aluminum,
wherein the cast part is an automotive engine component,
wherein the cast part has a microstructure that includes one or both of an $Al_5FeSi$ phase and an $Al_5(Fe,Mn)Si_2$ phase, and
wherein the alloy has a yield strength of at least 285 MPa at 20° C., at least 86 MPa at 250° C., and at least 50 MPa at 300° C.

25. Cast part made of aluminum alloy of chemical composition, expressed in percentages by weight, consisting essentially of:

Si: at least 3% and less than 9%
Fe<0.50%
Cu: 2.0-5.0%
Mn: 0.05-0.50%
Mg: 0.10-0.25%
Zn: <0.30%
Ni: <0.10%
V: 0.05-0.19%
Zr: 0.05-0.25%
Ti: 0.01-0.25%
optionally one or more elements to modify eutectics chosen from Sr (30-500 ppm), Na (20-100 ppm) and Ca (30-120 ppm), or Sb (0.05-0.25%) to refine eutectics, and
other elements <0.05% each and 0.15% in total, the rest aluminum,
wherein the cast part is an automotive engine component,
wherein the cast part has a microstructure that includes one or both of an $Al_5FeSi$ phase and an $Al_5(Fe,Mn)Si_2$ phase, and
wherein the alloy has a yield strength of at least 285 MPa at 20° C.

26. Cast part made of aluminum alloy of chemical composition, expressed in percentages by weight, consisting essentially of:

Si: at least 3% and less than 9%
Fe<0.50%
Cu: 2.0-5.0%
Mn: 0.05-0.50%
Mg: 0.10-0.25%
Zn: <0.30%
Ni: <0.10%
V: 0.05-0.19%
Zr: 0.05-0.25%
Ti: 0.01-0.25%
optionally one or more elements to modify eutectics chosen from Sr (30-500 ppm), Na (20-100 ppm) and Ca (30-120 ppm), or Sb (0.05-0.25%) to refine eutectics, and
other elements <0.05% each and 0.15% in total, the rest aluminum,
wherein the cast part is an automotive engine component,
wherein the cast part has a microstructure that includes one or both of an $Al_5FeSi$ phase and an $Al_5(Fe,Mn)Si_2$ phase, and
wherein the alloy has a yield strength of at least 285 MPa at 20° C., and at least 86 MPa at 250° C.

27. Cast part made of aluminum alloy of chemical composition, expressed in percentages by weight, consisting essentially of:

Si: at least 3% and less than 9%
Fe<0.50%
Cu: 2.0-5.0%
Mn: 0.05-0.50%
Mg: 0.10-0.25%
Zn: <0.30%
Ni: <0.10%
V: 0.05-0.19%
Zr: 0.05-0.25%
Ti: 0.01-0.25%
optionally one or more elements to modify eutectics chosen from Sr (30-500 ppm), Na (20-100 ppm) and Ca (30-120 ppm), or Sb (0.05-0.25%) to refine eutectics, and
other elements <0.05% each and 0.15% in total, the rest aluminum,
wherein the cast part is an automotive engine component,
wherein the cast part has a microstructure that includes one or both of an $Al_5FeSi$ phase and an $Al_5(Fe,Mn)Si_2$ phase, and
wherein the alloy has a yield strength of at least 285 MPa at 20° C., and at least 50 MPa at 300° C.

* * * * *